US007726711B1

(12) United States Patent
Steltzer

(10) Patent No.: US 7,726,711 B1
(45) Date of Patent: Jun. 1, 2010

(54) HEARING AID BATTERY REMOVAL TOOL AND ASSOCIATED METHOD

(76) Inventor: Monty D. Steltzer, 3846 S.W. Willowwood St., Prior Lake, MN (US) 55372

( * ) Notice: Subject to any disclaimer, the term of this patent is extended or adjusted under 35 U.S.C. 154(b) by 355 days.

(21) Appl. No.: 11/977,249

(22) Filed: Oct. 24, 2007

(51) Int. Cl.
*B25B 9/02* (2006.01)

(52) U.S. Cl. ..... 294/3; 294/65.5; 294/99.2; 7/901

(58) Field of Classification Search ..... 294/2, 294/3, 16, 65.5, 99.2; 7/101, 151, 901; 81/3.09, 81/3.55, 6–8
See application file for complete search history.

(56) References Cited

U.S. PATENT DOCUMENTS

| | | | | | |
|---|---|---|---|---|---|
| 251,182 | A * | 12/1881 | Bullock | ..... | 81/6 |
| 2,586,756 | A * | 2/1952 | Wolfe et al. | ..... | 29/213.1 |
| 3,304,111 | A * | 2/1967 | Kauh et al. | ..... | 294/99.2 |
| 4,437,362 | A * | 3/1984 | Hurst | ..... | 294/65.5 |
| 4,813,729 | A | 3/1989 | Speckhart | | |
| 5,288,119 | A | 2/1994 | Crawford, Jr. | | |
| 5,348,359 | A | 9/1994 | Boozer | | |
| 5,404,105 | A | 4/1995 | Chari | | |
| D397,006 | S | 8/1998 | Coleman, Jr. et al. | | |
| 6,039,185 | A | 3/2000 | Pedracine et al. | | |
| 6,056,339 | A | 5/2000 | Berger | | |
| 6,488,176 | B2 * | 12/2002 | Garrant et al. | ..... | 221/79 |
| 7,004,523 | B2 | 2/2006 | Pedrazzini | | |
| 7,076,075 | B2 | 7/2006 | Jørgensen | | |

* cited by examiner

*Primary Examiner*—Dean J Kramer
(74) *Attorney, Agent, or Firm*—Robert C. Montgomery

(57) ABSTRACT

The invention as presently conceived discloses a hand tool that assists in the removal and replacement of hearing aid batteries. The tool has a specially designed tweezer frame to aid in holding and placement of the small batteries. One side of the tweezer tip has a magnet that provides additional capabilities with holding the battery. The opposite side of the tweezer tip consists of a sharp point that aids in positioning or removing batteries from the battery compartment. Although the tool can benefit anyone who wears a hearing aid, it is particularly useful for the elderly.

10 Claims, 2 Drawing Sheets

HEARING AID BATTERY REMOVAL TOOL AND ASSOCIATED METHOD

RELATED APPLICATIONS

The present invention was first described in and claims the benefit of Disclosure Document No. 607,445 on Oct. 16, 2006.

FIELD OF THE INVENTION

This invention related to battery removing tools and, more particularly, to a hearing aid battery removal tool for assisting in the removal and replacement of hearing aid batteries.

BACKGROUND OF THE INVENTION

Hearing aids are used by a large number of people to help restore their hearing to a suitable level. Whether the hearing loss was caused by an accident, excessive loud noise, old age, a genetic abnormality or the like, the hearing aid allows these people to overcome their disability and become a full functioning member of society. Current electronic technology allows hearing aids to be extremely small which affords discretion for the user as well. However, their small nature also makes battery replacement very difficult, especially for those with reduced vision and dexterity. This is especially ironic since the typical hearing aid wearer is often afflicted with these other disabilities as well. Accordingly, there is a need for a means by which batteries in hearing aids can be easily replaced.

Several attempts have been made in the past to design a tool for assisting in the removal and replacement of hearing aid batteries. U.S. Pat. No. 5,288,119 in the name of Crawford discloses an apparatus for removing and replacing small batteries in electronic devices such as hearing aids. The invention has a housing in which a reciprocating shaft is placed, with a magnet at one end. When the reciprocating shaft is placed in its extended pickup position, the magnet is brought close to the end of the housing, and into contact with the battery or other magnetic object. Once in contact with the object, the apparatus may be used for manipulation. Once the object is placed where it is to be left, the reciprocating shaft may be moved to a retracted position, weakening the magnetic field, and holding the battery to the end of the apparatus. The reciprocating shaft is moved and locked into its extended and retracted positions with a rotating ratchet mechanism operated with a thumb of the hand that holds the apparatus. A shim in separable parts of the housing makes adjustment of the terminal end position of the magnet possible. A non-magnetic shield member or barrier layer surrounding the magnet at the tip effectively blocks the lateral attraction force so that only the object desired is picked up without disturbing surrounding objects. Unfortunately, this prior art example is not designed to open the battery door of a device.

U.S. Pat. No. 5,348,359 in the name of Boozer discloses an electromagnetic pick-up retriever tool having a number of interchangeable accessories to assist in locating, illuminating, viewing and retrieving both magnetic and non-magnetic objects such as small mechanical parts. The tool has a pistol-like handle which contains the power source and circuitry and which has a receptacle which selectively receives various attachments such as a bendable/reformable wand having an electromagnet at the end. Illuminating lights and fiber optic viewers may be selectively attached to the device. Unfortunately, this prior art example does not remove and install batteries in small devices.

U.S. Pat. No. 6,039,185 in the name of Pedracine discloses a thin flexible sheet of PETG or similar plastic with a disk shaped body with a number of radially protruding petals. The outer perimeter of one side of the inserter is coated with a pressure sensitive adhesive. A hearing aid battery with its connected selectively-gas-permeable tab is adhered to each of the inserter petals. Each petal has a small through hole positioned in alignment with the vent hole on the battery, which permits exchange of gases through the semipermeable tab. A battery is inserted into a hearing aid while attached to the inserter by gripping the inserter between the thumb and forefinger, and positioning the battery into an adjacent hearing aid battery compartment and then separated from the inserter by a sliding or wiping motion. The inserter is retained in a container fixed by removable side strips to a backing card. Unfortunately, this prior art example is not designed to open the battery door of a device.

None of the prior art particularly describes a hearing aid battery removal tool for assisting in the removal and replacement of hearing aid batteries. Accordingly, there is a need for a means by which batteries in hearing aids can be easily replaced. The present invention satisfies such a need by providing a tool that is convenient and easy to use, lightweight yet durable in design, and designed for assisting in the removal and replacement of hearing aid batteries. The present invention is simple to use, inexpensive, and designed for many years of repeated use.

SUMMARY OF THE INVENTION

In view of the foregoing disadvantages inherent in the prior art, it has been observed that there is need for assisting in the removal and the replacement of hearing aid batteries.

The present invention is an apparatus which assists in the removal and replacement of batteries used in hearing aids. The invention utilizes a tweezer frame to aid in holding and placement of the small batteries. One side of the tweezer tip comprises a magnet to further aid in the holding and retention effort. The other side of the tweezer tip is comprised of a sharp point to aid in positioning and/or removing the battery from the battery compartment.

A hearing aid battery removal tool includes a first linear tweezer arm, a second linear tweezer arm, and a pair of linear stiffener ribs monolithically formed with distal ends of the first and second tweezer arms such that the first and second tweezer arms are resiliently pivotable towards each other. A magnet is directly attached to the first tweezer arm.

The tool further includes a post directly attached to the second tweezer arm and is selectively engaged with the magnet. The magnet and the post are removably engaged when the first and second tweezer arms are biased towards each other for effectively providing a secure mechanical clamp about an existing hearing aid battery. The post is located at a tip of the second tweezer arm and includes a pointed metal tool oriented at a perpendicular and central location with respect to the face of the magnet when engaged therewith.

The tool further includes a linear tweezer base monolithically formed with the stiffener ribs, and an opener tool directly attached to a distal end of the tweezer base for unfastening an existing battery compartment portion of an existing hearing aid. The opener tool is conveniently formed from a rigid material and protrudes outwardly from the distal end of the tweezer base along a plane registered parallel thereto. The opener tool further has a thickness smaller than a thickness of the tweezer base.

The tool further includes a magnet holder connected to a proximal end of the first tweezer arm to advantageously maintain the magnet at a static and fixed position against the first tweezer arm. Such a magnet holder has a substantially cylindrical shape.

A method of utilizing a hearing aid battery removal tool includes the steps of: providing a tweezer frame with first and second resiliently adaptable tweezer arms; grasping a battery of a hearing aid; opening a battery compartment of the hearing aid by prying an opener tool therein; aligning a magnet with the battery and squeezing the first and second tweezer arms to thereby clamp the battery; sliding the battery vertically downward and out of the battery compartment; releasing and opening the first and second tweezer arms to thereby retain the battery securely upon the magnet; manually removing and discarding the battery; securing a new battery to the magnet of the tweezer frame; sliding the new battery into the battery compartment while maintaining the first and second tweezer at an open position; releasing the new battery from the magnet by sliding the magnet horizontally into the battery compartment; and closing the battery compartment by using the opener tool.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | hearing aid battery magnetic removal tool |
| 20 | first tweezer arm |
| 21 | stiffener |
| 22 | magnet |
| 23 | post |
| 24 | opener tool |
| 25 | magnet holder |
| 26 | tweezer base |
| 27 | second tweezer arm |
| 50 | battery |
| 51 | battery compartment |
| 52 | hearing aid |

DETAILED DESCRIPTION OF THE PREFERRED EMBODIMENT

Figures 1A, 1B:
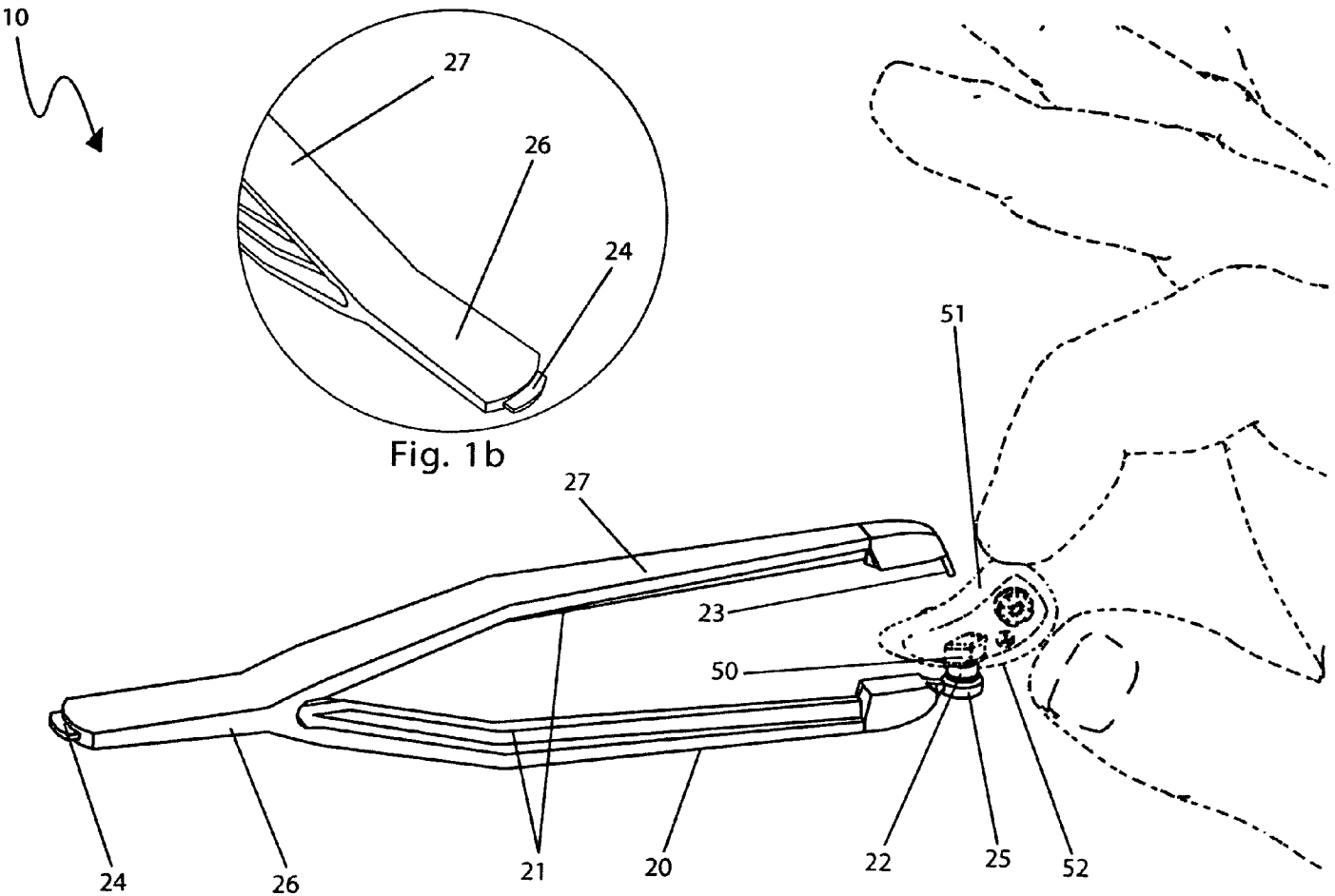
FIG. 1*a* is a side view of a hearing aid battery magnetic removal tool 10, according to a preferred embodiment of the present invention.
FIG. 1*b* is a close-up view of an opener tool portion 24 of the hearing aid battery magnetic removal tool 10, according to a preferred embodiment of the present invention; and, FIG. 2 is a close-up view of a magnet portion 22 of the hearing aid battery magnetic removal tool 10, according to a preferred embodiment of the present invention.
Figure 2:
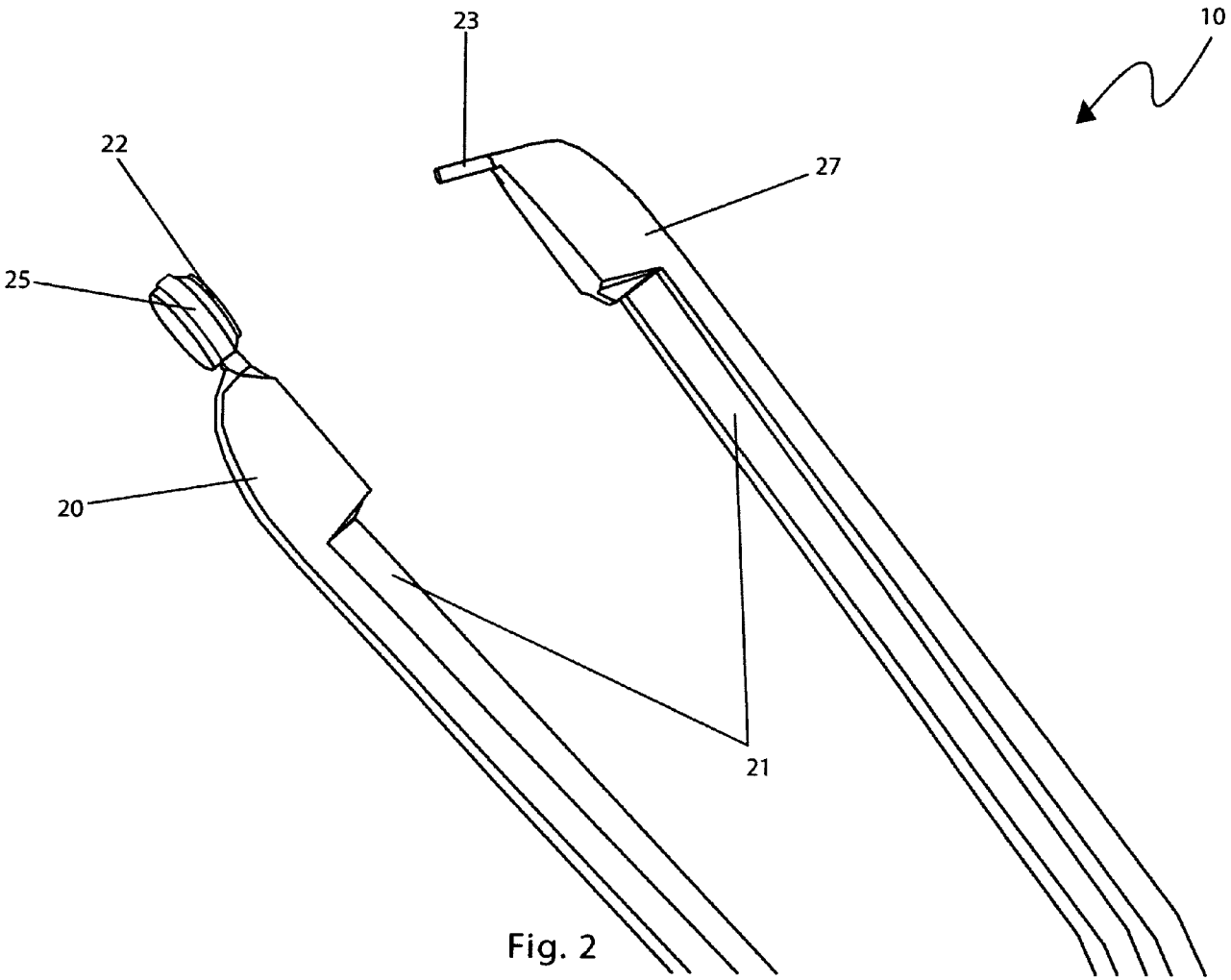

The best mode for carrying out the invention is presented in terms of its preferred embodiment, herein depicted within FIGS. 1 through 2. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a hearing aid battery magnetic removal tool (herein described as the "device") 10, which provides a means for a tweezer frame 20, 27, 26 to aid in holding and placement of the small batteries 50. A first tweezer arm 20 comprises a magnet 22 to further aid in the holding and retention effort and a second tweezer arm 27 is comprised of a post 23 to aid in positioning and/or removing of a spent battery 50 from the battery compartment 51 of a hearing aid 52 and replacing with a new battery 50. The device 10 provides the ability to replace hearing aid batteries 50 in a manner, which is quick, easy and effective.

Referring now to FIGS. 1*a* and 1*b*, a side view and a close-up view of the opener tool 24 portion of the device 10, according to the preferred embodiment of the present invention, are disclosed. The device 10 is illustrated here being applied to a miniature battery 50 being located therein a standard hearing aid 52; however, the device 10 may be used to remove small batteries 50 from a variety of appliances such as circuit boards, personal electronics, and the like, and as such should not be interpreted as a limiting factor of the present invention 10. The device 10 comprises a first tweezer arm 20, a second tweezer arm 27, a pair of stiffener ribs 21, a magnet 22, a post 23, an opener tool 24, a magnet holder 25, and a tweezer base 26. The device 10 comprises a pair of tweezers which are similar to conventional tweezers but with particular enhancements. The device 10 provides a fixed base 26 and a pair of freely moving arms 20, 27. The tweezer arms 20, 27 and tweezer base 26 are envisioned to be made using a preferred material of durable injection-molded plastic such as nylon, polypropylene, or the like; however, may be alternately provided using materials such as stainless steel or other metals. The stiffener ribs 21 provide a strengthening means to the tweezer arms 20, 27 during use and comprise molded-in linear ribs being located perpendicularly along an inclusive surface of each tweezer arm 20, 27.

Located at the free end of the first tweezer arm 20 is a magnet 22. Located at the free end of the second tweezer arm 27 is a post 23. The magnet 22 and post 23 combine to provide a secure mechanical clamping means during installation or removal of a battery 50 (see FIG. 2).

The tweezer base 26 comprises an integrally molded opener tool 24 (see FIG. 1*b*). The opener tool 24 provides a nimble prying means to unfasten and open the battery compartment 51 portion of the hearing aid 52, thereby gaining access to the battery 50. The opener tool 24 is envisioned to be a thin metal protrusion with rounded corners, thereby emulating a small screwdriver or fingernail. The opener tool 24 is envisioned being made using materials such as brass, stainless steel, or the like.

Referring now to FIG. 2, a close-up view of the magnet 22 portion of the device 10, according to the preferred embodiment of the present invention, is disclosed. The device 10 comprises a first tweezer arm 20, a second tweezer arm 27, a magnet 22, a magnet holder 25, and a post 23. The magnet 22 and the magnet holder 25 provide a magnetic holding means to a battery 50 during the installation or removal of said battery 50 and are envisioned to be integral to and located upon the tip of the first tweezer arm 20. The magnet holder 25 provides an attachment means to a miniature magnet 22 by such methods as the application of various adhesives or may be included in the aforementioned plastic injection molding process. The magnet 22 comprises a cylindrical-shaped miniature permanent magnet and is envisioned being made of ferrite or ceramic materials common in the industry.

The post 23 is located at the tip of the second tweezer arm 27 and comprises a pointed cylindrical metal tool preferably one-sixteenths (1/16) of an inch in diameter, and oriented at a perpendicular and central location with respect to the face of the magnet 22. The post 23 is envisioned to be molded integrally thereto the second tweezer arm 27; however, it may be provided using adhesives as an alternate attachment means. The post 23 is further envisioned to be made using non-magnetic materials such as brass, stainless steel, or the like.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be utilized as indicated in FIG. 1*a*.

The method of utilizing the device 10 may be achieved by performing the following steps: grasping and conveniently positioning a hearing aid 50 or other electronic appliance containing a miniature battery 50; opening the battery compartment door 51 using the opener tool 24, thereby exposing the spent battery 50; aligning the magnet 22 with the spent battery 50 and squeezing the tweezer arms 20, 27, thereby clamping said spent battery 50; sliding said battery 50 vertically downward and out of the battery compartment 51; releasing and opening the tweezer arms 20, 27 and, thereby retaining the spent battery 50 securely upon the magnet 22; manually removing and discarding the spent battery 50; securing a new battery 50 to the magnet 22 portion of the device 10; sliding the new battery 50 into the battery compartment holder 51 with the device 10 in the open state; releasing the new battery 50 from the magnet 22 by sliding the magnet 22 horizontally; closing the battery compartment 51 using the opener tool 24 as required; installing the hearing aid 52 into one's ear; and, benefiting from the increased nimbleness and time saved using the device 10 to change a miniature battery 50.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A hearing aid battery removal tool comprising:

a first tweezer arm;

a second tweezer arm;

a pair of stiffener ribs monolithically formed with distal ends of said first and second tweezer arms such that said first and second tweezer arms are resiliently pivotable towards each other;

a magnet directly attached to said first tweezer arm;

a post directly attached to said second tweezer arm and being selectively engaged with said magnet;

a tweezer base monolithically formed with said tweezer arms;

an opener tool directly attached to a distal end of said tweezer base for unfastening an existing battery compartment portion of an existing hearing aid; and, a magnet holder connected to a proximal end of said first tweezer arm to maintain said magnet at a static and fixed position against said first tweezer arm.

2. The hearing aid battery removal tool of claim 1, wherein said magnet and said post are removably engaged when said first and second tweezer arms are biased towards each other for providing a secure mechanical clamp about an existing hearing aid battery.

3. The hearing aid battery removal tool of claim 1, wherein said opener tool is formed from a rigid material and protrudes outwardly from said distal end of said tweezer base along a plane registered parallel thereto, said opener tool having a thickness smaller than a thickness of said tweezer base.

4. The hearing aid battery removal tool of claim 1, wherein said magnet holder has a substantially cylindrical shape.

5. The hearing aid battery removal tool of claim 1, wherein said post is located at a tip of said second tweezer arm and comprises a pointed metal tool oriented at a perpendicular and central location with respect to the face of the magnet when engaged therewith.

6. A hearing aid battery removal tool comprising:

a first linear tweezer arm;

a second linear tweezer arm;

a pair of linear stiffener ribs monolithically formed with distal ends of said first and second tweezer arms such that said first and second tweezer arms are resiliently pivotable towards each other;

a magnet directly attached to said first tweezer arm;

a post directly attached to said second tweezer arm and being selectively engaged with said magnet;

a linear tweezer base monolithically formed with said tweezer arms;

an opener tool directly attached to a distal end of said tweezer base for unfastening an existing battery compartment portion of an existing hearing aid; and, a magnet holder connected to a proximal end of said first tweezer arm to maintain said magnet at a static and fixed position against said first tweezer arm.

7. The hearing aid battery removal tool of claim 6, wherein said magnet and said post are removably engaged when said first and second tweezer arms are biased towards each other for providing a secure mechanical clamp about an existing hearing aid battery.

8. The hearing aid battery removal tool of claim 6, wherein said opener tool is formed from a rigid material and protrudes outwardly from said distal end of said tweezer base along a plane registered parallel thereto, said opener tool having a thickness smaller than a thickness of said tweezer base.

9. The hearing aid battery removal tool of claim 6, wherein said magnet holder has a substantially cylindrical shape.

10. The hearing aid battery removal tool of claim 6, wherein said post is located at a tip of said second tweezer arm and comprises a pointed metal tool oriented at a perpendicular and central location with respect to the face of the magnet when engaged therewith.

* * * * *